US005159327A

United States Patent [19]

Yi

[11] Patent Number: 5,159,327

[45] Date of Patent: Oct. 27, 1992

[54] SYNCHRONOUS SIGNAL POLARITY CONVERTER OF VIDEO CARD

[75] Inventor: Hyo S. Yi, Suweon, Rep. of Korea

[73] Assignee: Samsung Electronics Co., Ltd., Suweon, Rep. of Korea

[21] Appl. No.: 635,469

[22] Filed: Dec. 28, 1990

[30] Foreign Application Priority Data

Sep. 4, 1990 [KR] Rep. of Korea ..... 90-13947

[51] Int. Cl.[5] ..... G09G 3/00

[52] U.S. Cl. ..... 340/814; 358/148

[58] Field of Search ..... 358/148, 150, 140; 340/814, 803

[56] References Cited

U.S. PATENT DOCUMENTS 4,453,183 6/1984 Balaban et al. ..... 358/148
4,727,362 2/1988 Rackley et al. ..... 340/814
4,800,429 1/1989 Perkins ..... 358/148

*Primary Examiner*—Ulysses Weldon
*Assistant Examiner*—Matthew Luu
*Attorney, Agent, or Firm*—Ladas & Parry

[57] ABSTRACT

A synchronous signal polarity converter of a video card comprises a data output circuit including a graphic processor and a buffer, a driving control circuit, and a synchronous signal output circuit, wherein the polarity control data can be changed as desired and the desired polarity of the synchronous signals can be provided by combining the polarity-control data in a data storage circuit with the synchronous signals of graphic processor.

13 Claims, 2 Drawing Sheets

SYNCHRONOUS SIGNAL POLARITY CONVERTER OF VIDEO CARD

BACKGROUND OF THE INVENTION

The present invention relates to video cards and more particularly to a synchronous-signal polarity converter of a video card, which converts the polarity of synchronous signals provided from a video card in case of necessity, a monitor. Generally, the video cards are used in computers to display graphics etc. on a monitor. But, each polarity of synchronous signals of these video cards are different from each other according to makers. Thus, the user has to prepare either a monitor which is suitable to the polarity of synchronous signals provided from a video card or a video card which is suitable to the polarity of synchronous signals in a presently used monitor.

FIG. 1 is a conventional synchronous-signal generator of a video card. The graphic data provided from a graphic processor GP are transferred to a video random access memory (VRAM) or a dynamic random access memory (DRAM) for the storage of pixels according to the video data through a buffer BF. At this time, vertical synchronous signals (V-SYNC) and horizontal synchronous signals (H-SYNC) of a positive or negative polarity are respectively applied to exclusive OR gates EX-OR 1 and EX-OR 2 as shown in FIG. 1. Another terminals of the exclusive OR gates EX-OR 1 and EX-OR 2 are grounded. Thus, the exclusive OR gates EX-OR1 and EX-OR2 provide the vertical and horizontal synchronous signals respectively, without changing the polarity of the vertical and horizontal synchronous signals. However, the user must select a video card according to the synchronous-signal polarity of a presently used monitor, since the polarity of the vertical and horizontal synchronous signals were already determined according to the video cards.

SUMMARY OF THE INVENTION

The present invention has an object to provide a synchronous-signal polarity converter circuit of a video card which converts the polarities of synchronous signals by combining the synchronous signals from a graphic processor with polarity-control data which are provided from a graphic processor and controlled according to the manipulation of the user, and stored in a data storage circuit.

According to the present invention, there is provided a synchronous signal polarity converter of a video card comprising: a data output circuit including a graphic processor for providing graphic data, a polarity control data, and synchronous signals, and a buffer for normalizing various data outputs of said graphic processor: a driving-control circuit connected to said graphic processor for providing an enable signal according to a write signal of said graphic processor or a memory address signal provided from a computer; and a synchronous-signal output circuit connected to said graphic processor, said buffer, and said driving-control circuit for providing new synchronous signals by combining the synchronous signals provided from said graphic processor with the signals applied from said buffer driven the enable signal of said driving-control circuit.

BRIEF DESCRIPTION OF THE DRAWINGS

These and other objects, features, and advantages of the present invention will become more apparent from the following description for the preferred embodiments taken in conjunction with the accompanying drawings, in which.

DETAILED DESCRIPTION OF THE PREFERRED EMBODIMENTS

The present invention will be now described in more detail with reference to the accompanying drawings.

Figure 1:
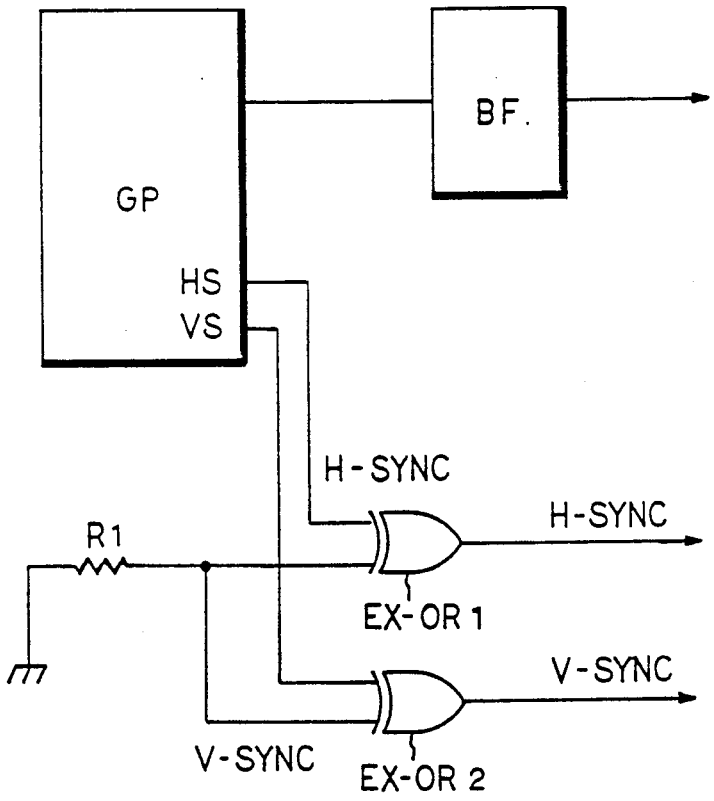
FIG. 1 (PRIOR ART)
FIG. 1 is a conventional synchronous signal generator circuit of a video card.
Figure 2:
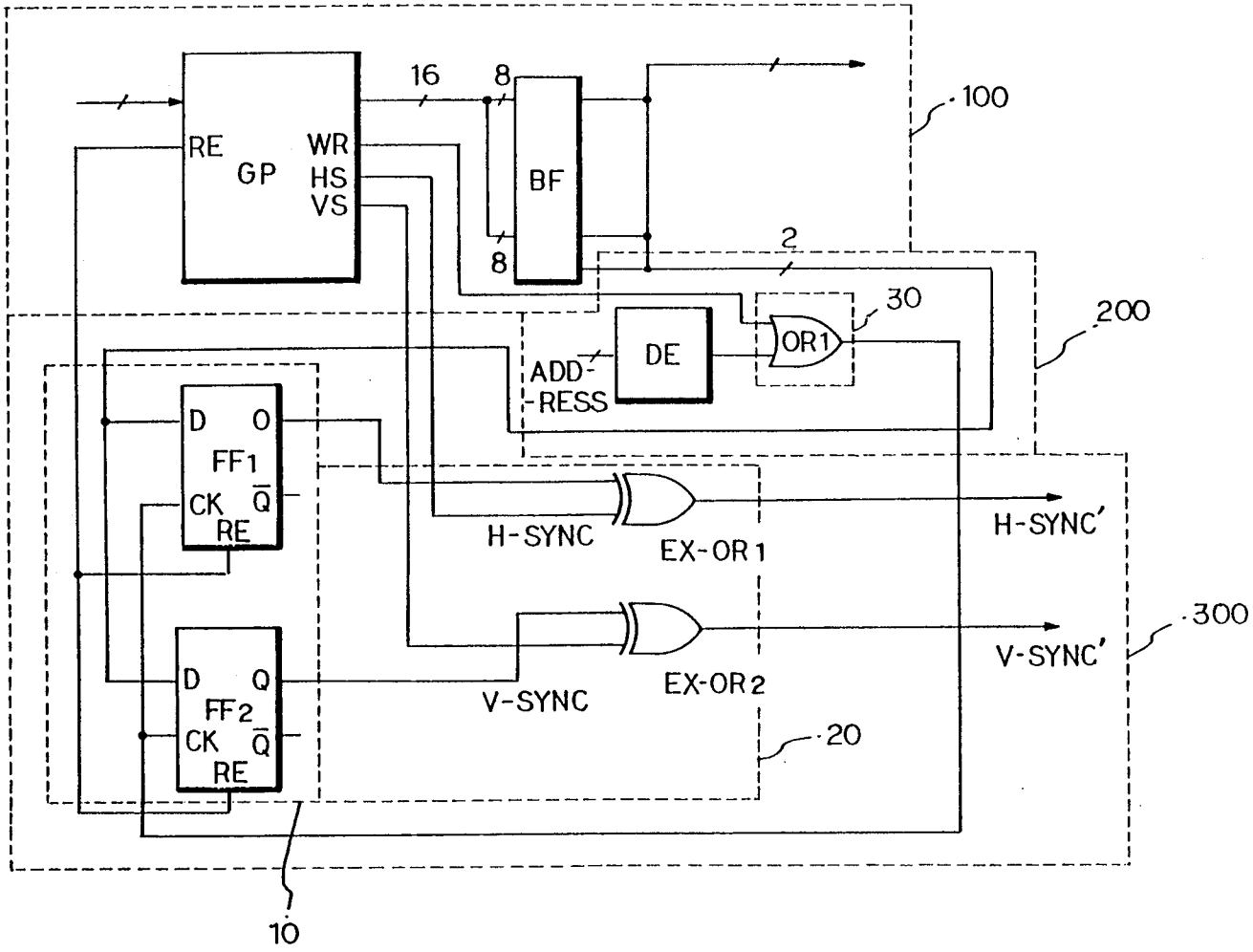
FIG. 2 is a synchronous signal polarity converter circuit of a video card according to the present invention.

FIG. 2 shows a synchronous-signal generator circuit of a video card according to the present invention, which comprises a data output circuit 100, a driving-control circuit 200, and a synchronous-signal output circuit 300.

To describe in detail, the data output circuit 100 includes a graphic processor GP for providing graphic data, polarity control data, and the synchronous signals according to the control of a computer, and a buffer BF for normalizing output signals of the graphic processor GP. The graphic processor GP provides the vertical and horizontal synchronous signals of the positive or negative polarity according to the control of a ROM(-Read Only Memory) bias or a system firmware(not shown in FIG. 2).

Next, the driving-control circuit 200 connected to the graphic processor for providing enable signals according to write signals of the graphic processor GP or memory address signals of the computer(not shown in FIG. 2) includes a decoder DE for decoding the input address signal and an OR gate OR1 for combining the output of the decoder DE with the write signal of the graphic processor GP. A second logic combination part 30 includes gate OR1, where the OR gate OR1 may be replaced by an AND gate if necessary.

Finally, the synchronous-signal output circuit 300 connected to the graphic processor GP, the buffer BF and the driving control circuit 200 provides new synchronous signals by combining the synchronous signals provided from the graphic processor GP with the polarity control data provided from the buffer BF, by driving the enable signal of the driving control circuit 200, and includes a data storage circuit 10 and a first logic combination circuit 20. The data storage part 10 uses the enable signal of the driving-control circuit 200, that is, the output of the OR gate OR1 as a clock signal and includes two D-type flip-flops FF1 and FF2.

Both input terminals of the flip-flops FF1 and FF2, are supplied with the polarity-control data provided from the buffer BF. Also, a reset signal provided from a reset terminal RE of the graphic processor GP is applied to both reset terminals RE of the flip-flops FF1 and FF2 and thus the flip-flops FF1 and FF2 are reset by the graphic processor GP.

The output terminal of the OR gate OR1 is connected to clock terminals CK of the flip-flops FF1 and FF2, thus the output signal of the OR gate OR1 is used as the clock signals of the flip-flops FF1 and FF2. The first logic combination part 20 includes two exclusive-OR gates EX-OR1 and EX-OR2 which combine the horizontal and vertical synchronous signals H-SYNC and V-SYNC provided from the graphic processor GP with outputs of the flip-flops FF1 and FF2 to provide new horizontal and vertical synchronous signals H-SYNC' and V-SYNC'. The output signals of the flip-flops FF1 and FF2 are used as the polarity-control data for the horizontal and vertical synchronous signals. In the synchronous-signal polarity converter as shown in FIG. 2, the graphic processor GP provides the graphic data to a VRAM or DRAM.

On the other hand, the gaphic processor GP is connected to the ROM bias or the system firmware, where a polarity-assign program for the horizontal and vertical synchronous signals H-SYNC and V-SYNC is stored. Thus, the user can control the polarity of the horizontal and vertical synchronous signals by the polarity-assign program stored in the ROM bias or the system firmware. Therefore, if it is desired to convert the polarity of the horizontal and vertical synchronous signals from negative to positive, the graphic processor GP provides the polarity-control data of high level to the buffer BF by manipulating the polarity-assignment program in the ROM bias or the system firmware. Also, the user controls the graphic processor to provide the write signal through a terminal WR, or controls the computer to provide the corresponding address signals to the decoder DE.

Then, the second logic combination part 30, that is, the OR gate OR1 provides the enable signal of high level to select the flip-flops FF1 and FF2 in the data storage part 10 when either the write signal of the graphic processor GP or the decoded output of the address signal provided from the computer is high level. The OR gate OR1 may be replaced by the AND gate in the second logic combination part 30 so that the enable signal is provided only when the write signal of the graphic processor GP is high level and the address signals provided from the computer corresponds to the assigned address of the flip-flops FF1 and FF2. Then, the flip-flops FF1 and FF2 are ready to receive the polarity-control data, and subsequently the graphic processor GP provides 2-bit polarity-control data of high level which is provided from the ROM bias or the system firmware (not shown in FIG. 2) by controlling the flip-flops FF1 and FF2 through the buffer BF. Then, the outputs of the flip-flops FF1 and FF2 becomes 'H'.

Next, the negative horizontal and vertical synchronous signals H-SYNC and V-SYNC are combined with the polarity-control data of high level by the exclusive OR gates EX-OR1 and EX-OR2 in the first logic combination part 20, respectively. To the contrary, if the user wants to convert the polarity of the horizontal and vertical synchronous signals H-SYNC and V-SYNC from positive to negative, the user controls the graphic processor GP to provide the polarity-control data of low level. In the same manner, also, the flip-flops FF1 and FF2 are enabled and their outputs are set to low level.

Next, these polarity-control data of low level and the horizontal and vertical synchronous signals H-SYNC and V-SYNC are combined with each other by the exclusive OR gates EX-OR1 and EX-OR2, respectively and thus new negative horizontal and vertical synchronous signals H-SYNC' and V-SYNC' are provided.

As mentioned above the present invention makes it possible for the user to change the polarity-control data in as desired and provides the desired polarities of synchronous signals by combining the polarity-control data in the data storage circuit 10 with the synchronous signals provided the graphic processor. Thus, the user can select an arbitrary video card for any monitor which uses either negative or positive synchronous signals.

The invention is in no way limited to the embodiment described hereinabove. Various modifications of the disclosed embodiment as well as other embodiments of the invention will become apparent to persons skilled in the art upon reference to the description of the invention. It is therefore contemplated that the appended claims will cover any such modifications or embodiments as fall within the true scope of the present invention.

What is claimed is:

1. A synchronous signal polarity converter of a video card, comprising:

a data output circuit including a graphic processor for providing graphic data, a polarity control data, and synchronous signals, and a buffer for moralizing said graphic data and polarity control data of said graphic processor;

a driving control circuit connected to said graphic processor for providing an enable signal according to a write signal of said graphic processor or a memory address signal of a computer; and a synchronous signal output circuit connected to said graphic processor, said buffer, and said driving control circuit for providing new synchronous signals selectable to either a positive or a negative polarity by combining the synchronous signals provided from said graphic processor with the polarity control data provided from said buffer driven by the enable signal of said driving control circuit.

2. A synchronous signal polarity converter of a video card according to claim 1, wherein said synchronous signal output circuit comprise:

a data storage part connected to said driving control circuit and to said buffer to be driven by the enable signal of said driving control circuit, for storing the polarity control data of said buffer; and a first logic combination part connected to said data storage part and said graphic processor for combining the synchronous signals provided from said graphic processor with said polarity control data stored in said data storage part.

3. A synchronous signal polarity converter of a video card according to claim 1, wherein said driving control circuit comprises a decoder for decoding the address signals provided from the computer and a second logic combination part connected to said decoder and said graphic processor for combining the write signal of said graphic processor with an output of said decoder.

4. A synchronous signal polarity converter of a video card according to claim 2, wherein said data storage part comprises:

a first D-type flip-flop connected to said driving control circuit and to said buffer to be driven by the enable signal of said driving control circuit for storing the polarity control data provided from said buffer; and a second D-type flip-flop connected connected to said driving control circuit and to said driving control circuit fir storing the polarity data provided from said buffer.

5. A synchronous signal polarity converter of a video card according to claim 2, wherein said first logic combination part comprises:

a first exclusive OR-gate for combining a horizontal synchronous signal provided from said graphic processor with an output data of said first D-type flip-flop; and second exclusive OR-gate for combining a vertical synchronous signal provided from said graphic processor with an output data of said second D-type flip-flop.

6. A synchronous signal polarity converter of a video card according to claim 3, wherein said second logic combination circuit part comprises an OR-gate connected to said decoder and to said graphic processor for combining the output of said decoder with the write signal of said graphic processor.

7. A synchronous signal polarity converter of a video card according to claim 6, wherein said second logic combination part may be replaced by an AND gate for said OR gate.

8. A synchronous signal polarity converter of a video card comprising:

a data output circuit including a graphic processor for providing graphic data, a polarity control data, and synchronous signals, and a buffer for normalizing said graphic data and polarity control data of said graphic processor;

a driving control circuit connected to said graphic processor for providing an enable signal according to a write signal of said graphic processor or a memory address signal of a computer; and a synchronous signal output circuit connected to said graphic processor, said buffer, and said driving control circuit for providing new synchronous signals by combining the synchronous signals provided from said graphic processor with the polarity control data provided from said buffer driven by the enable signal of said driving control circuit, said synchronous signal output circuit comprising a data storage part connected to said driving control circuit and to said buffer to be driven by the enable signal of said driving control circuit, for storing the polarity control data of said buffer and a first logic combination part connected to said data storage part and said graphic processor for combining the synchronous signals provided from said graphic processor with said polarity control data stored in said data storage part.

9. A synchronous signal polarity converter of a video card according to claim 8, wherein said driving control circuit comprises a decoder for decoding the address signals provided from the computer and a second logic combination part connected to said decoder and said graphic processor for combining the write signal of said graphic processor with an output of said decoder.

10. A synchronous signal polarity converter of a video card according to claim 8, wherein said data storage part comprises:

a first D-type flip-flop connected to said driving control circuit and to said buffer to be driven by the enable signal of said driving control circuit for storing the polarity control data provided from said buffer; and a second D-type flip-flop connected to said driving control circuit and to said driving control circuit for storing the polarity data provided from said buffer.

11. A synchronous signal polarity converter of a video card according to claim 8, wherein said first logic combination part comprises:

a first exclusive OR-gate for combining a horizontal synchronous signal provided from said graphic processor with an output data of said first D-type flip-flop; and second exclusive OR-gate for combining a vertical synchronous signal provided from said graphic processor with an output data of said second D-type flip-flop.

12. A synchronous signal polarity converter of a video card according to claim 9, wherein said second logic combination circuit part comprises an OR-gate connected to said decoder and to said graphic processor for combining the output of said decoder with the write signal of said graphic processor.

13. A synchronous signal polarity converter of a video card according to claim 12, wherein said second logic combination part may be replaced by an AND gate for said OR gate.

* * * * *